US011110730B2

(12) United States Patent
Kim et al.

(10) Patent No.: US 11,110,730 B2
(45) Date of Patent: Sep. 7, 2021

(54) INKJET PRINTER APPARATUS AND METHOD OF DRIVING THE SAME

(71) Applicant: Samsung Display Co., Ltd., Yongin-Si (KR)

(72) Inventors: Dongsul Kim, Hwaseong-si (KR); Honggi Min, Hwaseong-si (KR); Minsoo Kim, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/575,799

(22) Filed: Sep. 19, 2019

(65) Prior Publication Data

US 2020/0139737 A1 May 7, 2020

(30) Foreign Application Priority Data

Nov. 7, 2018 (KR) ..... 10-2018-0135886

(51) Int. Cl.
*B41J 29/393* (2006.01)
*B41J 2/045* (2006.01)

(52) U.S. Cl.
CPC ..... *B41J 29/393* (2013.01); *B41J 2/04501* (2013.01)

(58) Field of Classification Search
CPC ..... B41J 29/393; B41J 2/04501
See application file for complete search history.

(56) References Cited

U.S. PATENT DOCUMENTS

2006/0092199 A1* 5/2006 White ..... B41J 2/0459 347/9
2006/0092204 A1* 5/2006 White ..... B41J 2/0459 347/12
2006/0093751 A1* 5/2006 White ..... B41J 25/003 427/466
2018/0311952 A1* 11/2018 Cui ..... B41J 2/04581

FOREIGN PATENT DOCUMENTS

JP 3245957 B2 1/2002
KR 1020060058965 A 6/2006
KR 100976702 B1 8/2010
KR 1020160031201 A 3/2016
KR 101733904 B1 4/2017

* cited by examiner

*Primary Examiner* — Jason S Uhlenhake
(74) *Attorney, Agent, or Firm* — Cantor Colburn LLP

(57) ABSTRACT

An inkjet printer apparatus includes a printing head including a plurality of nozzles for printing an ink in a plurality of pixels arranged as a matrix type in a target substrate, a control circuit which moves the printing head in an x-direction crossing an y-direction of a scan direction, and determines an optimal position for using largest nozzles, and a driving part which moves the printing head to the optimal position and moves the printing head along the y-direction in the optimal position.

16 Claims, 10 Drawing Sheets

INKJET PRINTER APPARATUS AND METHOD OF DRIVING THE SAME

This application claims priority to Korean Patent Application No. 10-2018-0135886, filed on Nov. 7, 2018, and all the benefits accruing therefrom under 35 U.S.C. § 119, the content of which in its entirety is herein incorporated by reference.

BACKGROUND

1. Field

Exemplary embodiments of the invention relate to an inkjet printer apparatus and a method of driving the inkjet printer apparatus. More particularly, exemplary embodiments of the invention relate to an inkjet printer apparatus for maximizing a number of used nozzles and a method of driving the inkjet printer apparatus.

2. Description of the Related Art

An inkjet printer uses metallic materials such as copper, gold, and silver as well as ceramics and polymers as printing solutions as well as general dyes. The inkjet printer is used in various fields such as industrial graphics, displays, and solar cells by directly printing on substrates, films, textiles, and displays. Particularly, in the field of the displays, processes using the inkjet printer are applied to manufacture of a color filter, a liquid crystal layer, and an organic light emitting layer, for example.

In a liquid crystal display device, a color filter layer may be formed by an inkjet printing method in a pixel space defined by a black matrix formed on a substrate.

In addition, in an organic light emitting display device, a hole injection layer, an organic emission layer, an electron injection layer, and the like may be formed on a substrate in a pixel space defined by a pixel defining layer by an inkjet printing method.

SUMMARY

An inkjet printer includes a printing head including a plurality of nozzles. A target substrate is scanned with the printing head, and an ink is injected onto a printing area formed on the target substrate to be printed. The target substrate includes the printing area where the ink is printed and an un-printed area where ink is not printed. During one scan of the printing head, the nozzles corresponding to the non-printing area do not inject the ink at all.

As described above, when a time for which the nozzle is not used is increased, the nozzle may be clogged.

Exemplary embodiments of the invention provide an inkjet printer apparatus for maximizing a number of used nozzles.

Exemplary embodiments of the invention provide a method of driving the inkjet printer apparatus.

According to an exemplary embodiment of the invention, there is provided an inkjet printer apparatus including a printing head including a plurality of nozzles which prints an ink in a plurality of pixels arranged as a matrix type in a target substrate, a control circuit which moves the printing head in an x-direction crossing an y-direction of a scan direction, and determines an optimal position for using largest nozzles of the plurality of nozzles, and a driving part which moves the printing head to the optimal position and moves the printing head along the y-direction in the optimal position.

In an exemplary embodiment, the control circuit may determine n pixels, among the plurality of pixels, arranged in the x-direction of the target substrate corresponding to an x-direction length of the printing head, to a pixel group, and determine the optimal position of the printing head within an x-direction length of a first pixel, among the plurality of pixels, of the pixel group.

In an exemplary embodiment, the control circuit may align an end portion of a first nozzle, among the plurality of nozzles, in the printing head and an end portion of the first pixel of the pixel group to determine an initial position, and determine the optimal position of the printing head using a reference shift value preset with respect to the x-direction length of the first pixel in the printing head.

In an exemplary embodiment, the control circuit may divide the x-direction length of the first pixel by the reference shift value to determine a shift position, calculate a number of nozzles, among the plurality of nozzles, of the printing head matching the pixels of the pixel group in the shift position, and determine the shift position having a maximum number of nozzles, among the plurality of nozzles, of the printing head to the optimal position.

In an exemplary embodiment, the shift position may be within the x-direction length of the first pixel.

In an exemplary embodiment, the reference shift value may be greater than a diameter of an ink injected from a nozzle of the plurality of nozzles and smaller than a spacing between adjacent nozzles of the plurality of nozzles.

In an exemplary embodiment, the reference shift value may be defined by following; Diameter of Droplet±k1≤Reference shift value (dx)≤Spacing between Nozzles±k2, where Droplet is an ink drop ID injected from a nozzle of the plurality of nozzles, and k1 and k2 are experimental values.

In an exemplary embodiment, the ink may be a light emitting layer used in a manufacturing process of an organic light emitting display device.

In an exemplary embodiment, the light emitting layer may include a hole injection layer, a hole transport layer, an electron transport layer, an organic light emitting layer, and an electron injection layer.

In an exemplary embodiment, the ink may be a color filter layer used in a manufacturing process of a liquid crystal display device.

According to an exemplary embodiment of the invention, there is provided a method of driving the inkjet printer apparatus which includes a printing head including a plurality of nozzles for printing an ink in a plurality of pixels arranged as a matrix type in a target substrate. The method includes moving the printing head in an x-direction crossing a y-direction of a scan direction, determining an optimal position for using largest nozzles of the plurality of nozzles, moving the printing head to the optimal position, and moving the printing head along the y-direction in the optimal position.

In an exemplary embodiment, the method further may include determining n pixels among the plurality of pixels, arranged in the x-direction of the target substrate corresponding to an x-direction length of the printing head, to a pixel group, and determining the optimal position of the printing head within the x-direction length of a first pixel, among the plurality of pixels, of the pixel group.

In an exemplary embodiment, the method may further include aligning an end portion of a first nozzle, among the plurality of nozzles, in the printing head and an end portion of the first pixel of the pixel group to determine an initial position, and determining the optimal position of the printing head using a reference shift value preset with respect to the x-direction length of the first pixel in the printing head.

In an exemplary embodiment, the method may further include dividing the x-direction length of the first pixel by the reference shift value to determine a shift position, calculating a number of nozzles, among the plurality of nozzles, of the printing head matching the pixels of the pixel group in the shift position, and determining the shift position having a maximum number of nozzles, among the plurality of nozzles, of the printing head as the optimal position.

In an exemplary embodiment, the shift position may be within the x-direction length of the first pixel.

In an exemplary embodiment, the reference shift value may be greater than a diameter of an ink injected from a nozzle of the plurality of nozzles and smaller than a spacing between adjacent nozzles of the plurality of nozzles.

In an exemplary embodiment, the reference shift value may be defined by following; Diameter of Droplet±k1≤Reference shift value (dx)≤Spacing between Nozzles±k2, where Droplet is an ink drop ID injected from a nozzle of the plurality of nozzles, and k1 and k2 are experimental values.

In an exemplary embodiment, the ink may be a light emitting layer used in a manufacturing process of an organic light emitting display device.

In an exemplary embodiment, the light emitting layer may include a hole injection layer, a hole transport layer, an electron transport layer, an organic light emitting layer, and an electron injection layer.

In an exemplary embodiment, the ink may be a color filter layer used in a manufacturing process of a liquid crystal display device.

According to the exemplary embodiments of the invention, the optimal position of the printing head to maximize the plurality of nozzles included in the printing head may be determined. A use efficiency of the nozzle of the printing head may be improved by printing the target substrate in the optimal position. In addition, defects such as clogging of a nozzle that occurs due to not using the nozzle for a long time may be improved. In addition, since the ink is injected by many nozzles, the printing completion time may be shortened.

BRIEF DESCRIPTION OF THE DRAWINGS

The above and other features and advantages of the invention will become more apparent by describing in detailed exemplary embodiments thereof with reference to the accompanying drawings, in which.

DETAILED DESCRIPTION

Figure 1:
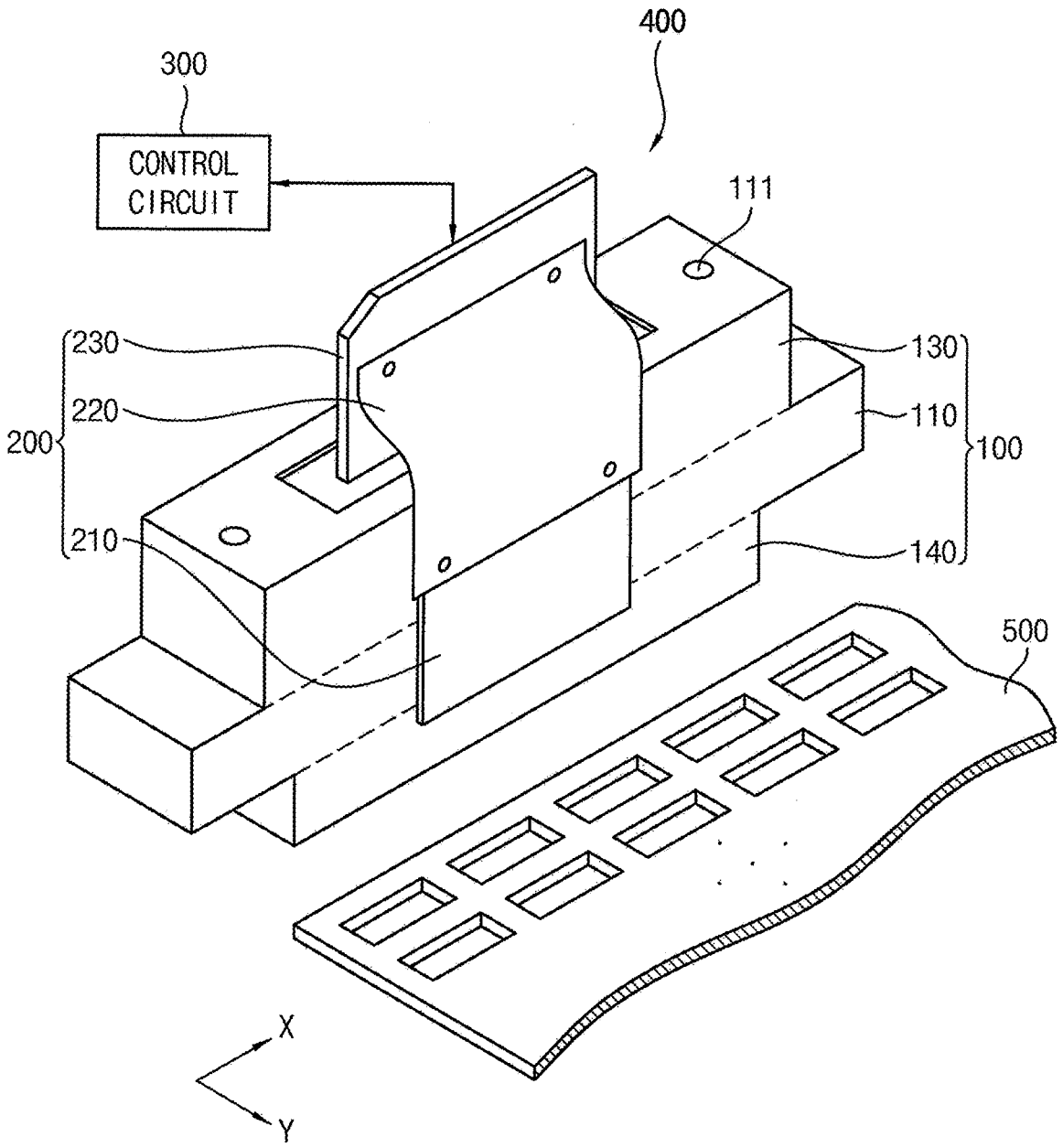
FIG. 1 is a perspective view illustrating an exemplary embodiment of an inkjet printer apparatus.

Hereinafter, the invention will be explained in detail with reference to the accompanying drawings.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Figure 2A:
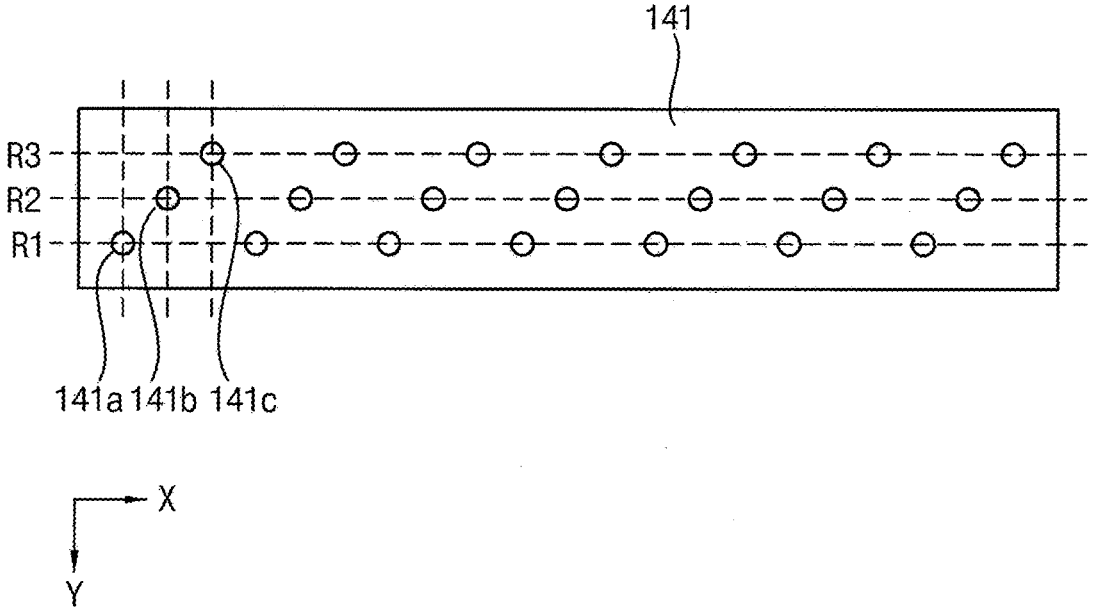
FIGS. 2A and 2B are a rear view and a front view illustrating the inkjet printer apparatus shown in FIG. 1.
Figure 2B:
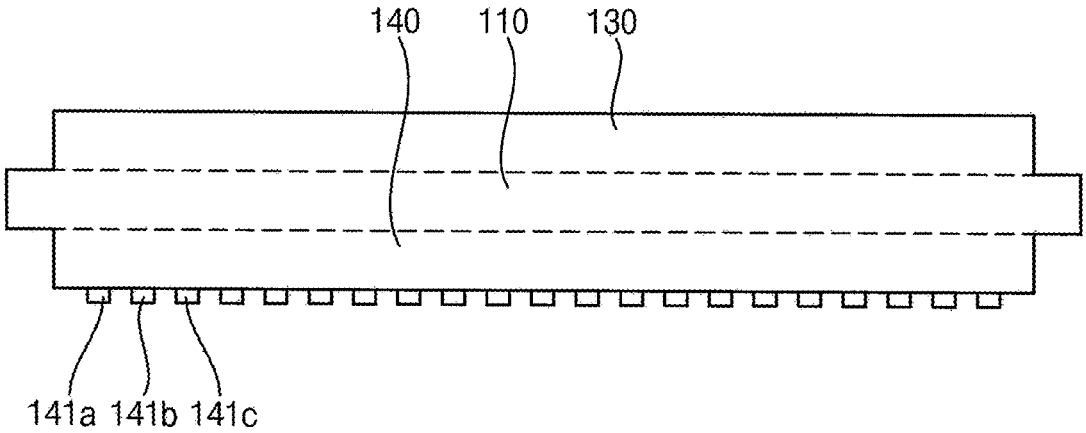

FIG. 1 is a perspective view illustrating an exemplary embodiment of an inkjet printer apparatus. FIGS. 2A and 2B are a rear view and a front view illustrating the inkjet printer apparatus shown in FIG. 1.

Referring to FIG. 1, the inkjet printer apparatus 400 may include a printing head 100, a driving part 200, and a control circuit 300.

The printing head 100 may include a main body 110, an ink storage part 130, and a nozzle part 140.

The main body 110 may serve as a frame of a printing head. The main body 110 may have various shapes. In an exemplary embodiment, the main body 110 may have a rectangular pillar shape, for example.

The main body 110 may include an ink injection part 111 disposed on both sides of the main body 110. The ink injection part 111 may include a hole defined in the main body 110. The ink injecting part 111 may be provided with various kinds of ink compositions, cleaning agents, and the like.

The nozzle part 140 may be disposed under the ink storage part 130.

The nozzle part 140 may include a piezoelectric ceramic film. In an exemplary embodiment, the piezoelectric ceramic film may be lead zirconate titanate ("PZT"), for example.

Referring to FIG. 2A, the nozzle part 140 includes a plurality of nozzles 141 for injecting the ink. The plurality of nozzles 141 may be arranged on a back surface of the main body 110.

The plurality of nozzles 141 may be arranged in a plurality of rows R1, R2 and R3. In an exemplary embodiment, a first nozzle 141*a* of a first row R1 may be spaced apart from a second nozzle 141*b* of a second row R2 in an x-direction X, for example. The second nozzle 141*b* of the second row R2 may be spaced apart from a third nozzle 141*c* of a third row R3 in the x-direction X.

Referring to FIG. 2B, when the inkjet printer apparatus 400 is viewed from the front, first nozzles 141*a*, second nozzles 141*b* and third nozzles 141*c* which are arranged in the plurality of rows R1, R2 and R3, are arranged as a plurality of columns 141*a*, 141*b*, 141*c*, 141*a*, 141*b*, 141*c*, . . . in the x-direction X.

The driving part 200 may include a driving circuit 210.

The driving circuit 210 may be disposed on a side surface of the main body 110.

Although not shown in drawing figures, the driving circuit 210 may include a circuit on which a plurality of transistors, a plurality of resistors, a plurality of capacitors, and the like are integrated on a silicon substrate. The driving circuit 210 may drive the nozzle part 140 to inject the ink. The driving circuit 210 may control a movement of the printing head 100 in the x-direction X and a y-direction Y crossing the x-direction X based on the control of the control circuit 300.

The driving part 200 may further include a flexible circuit board 220 and a printed circuit board 230 that electrically connect the driving circuit 210 with the control circuit 300.

The control circuit 300 may control an overall printing operation of the inkjet printer apparatus 400 through the driving part 200.

In an exemplary embodiment, the control circuit 300 may shift the printing head 100 in the x-direction X crossing the y-direction Y that is a scan direction of the printing head 100. The control circuit 300 may determine an optimal position of the printing head 100 in order to maximize the use of a plurality of nozzles 141*a*, 141*b* and 141*c* of the inkjet printer apparatus 400 with respect to a target substrate 500.

Figure 3:
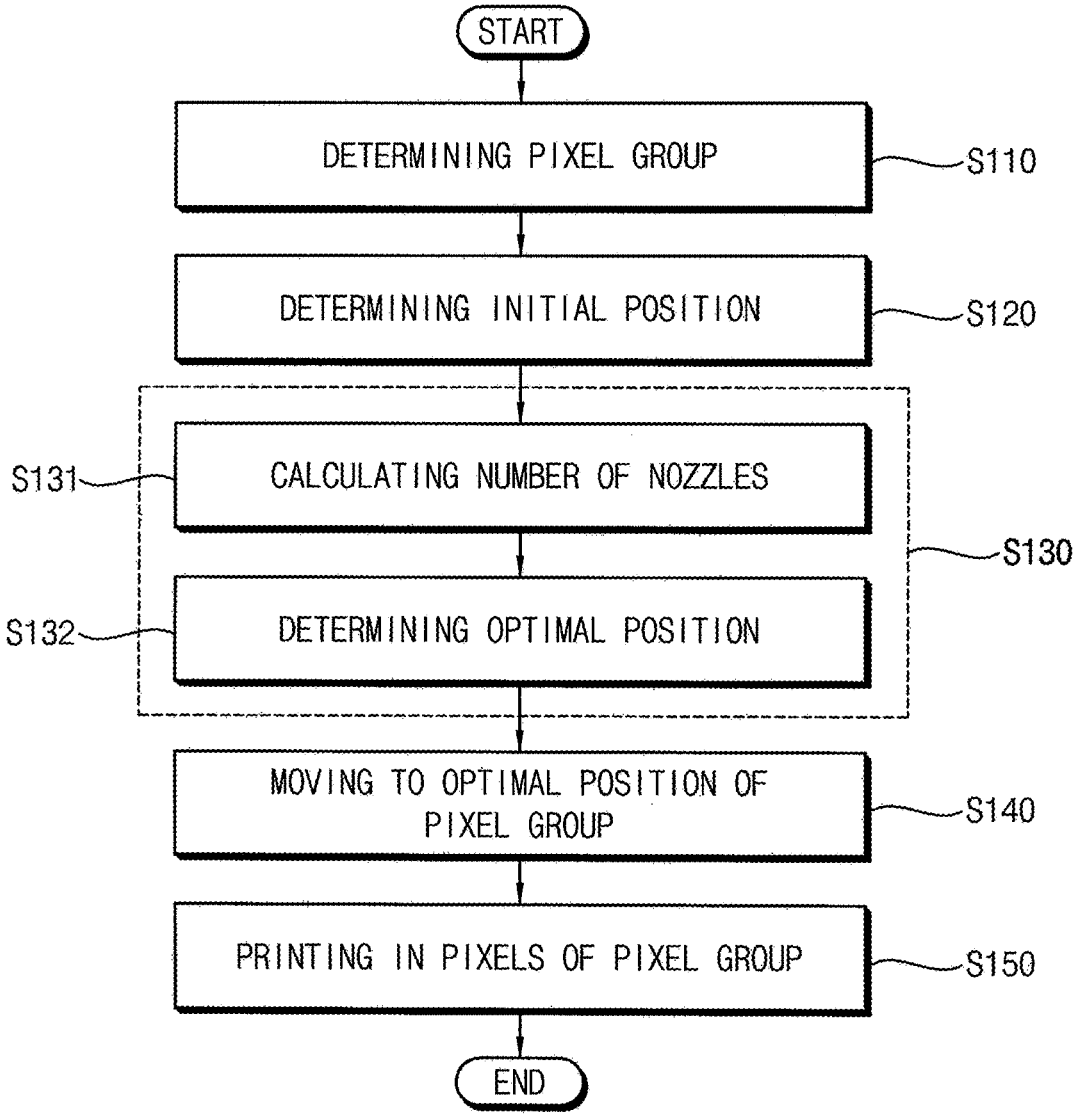
FIG. 3 is a flowchart illustrating an exemplary embodiment of a driving method of an inkjet printer apparatus.
Figure 4:
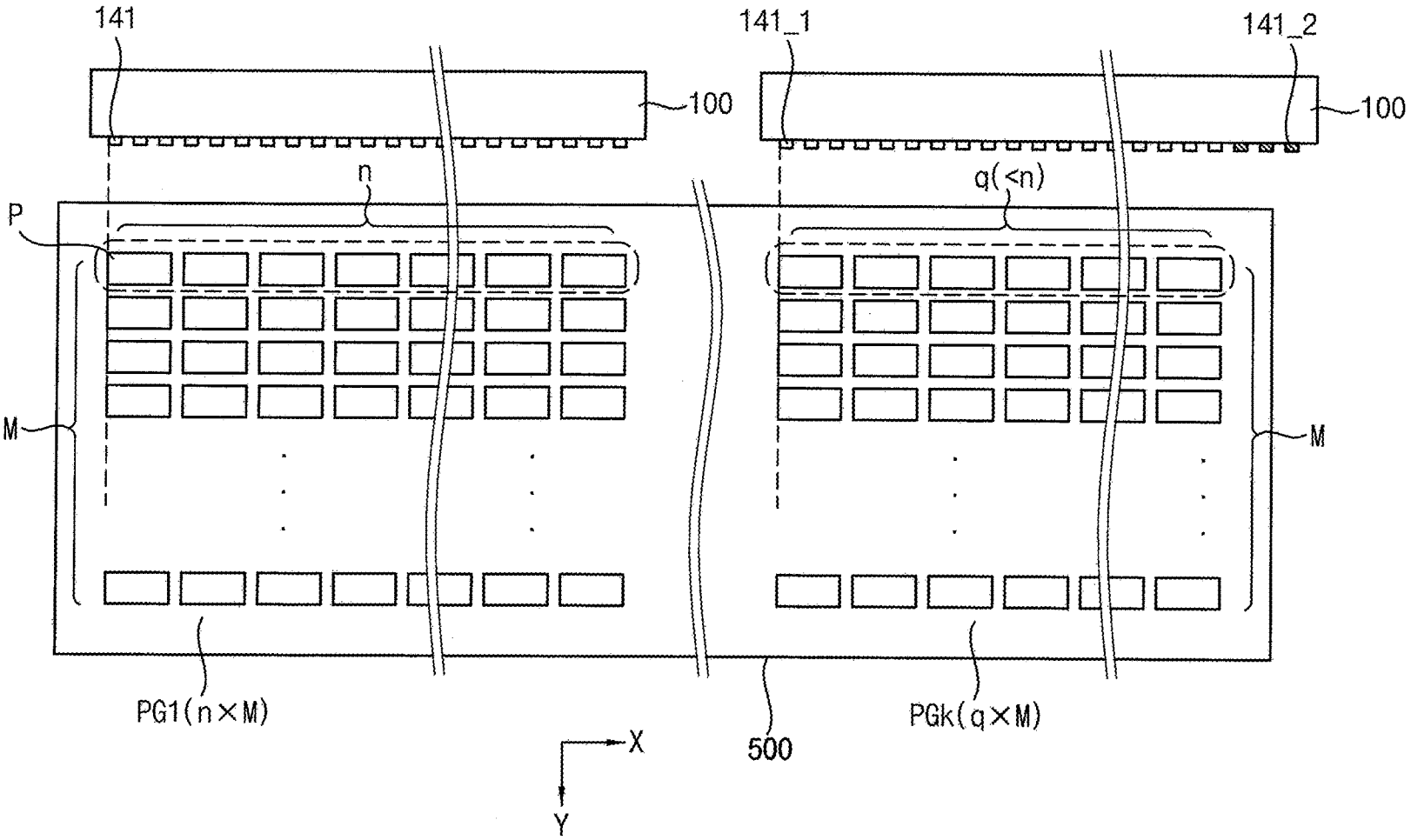
FIG. 4 is a conceptual diagram illustrating an operation S110 of the method of driving the inkjet printer apparatus of FIG. 3.

FIG. 3 is a flowchart illustrating an exemplary embodiment of a driving method of an inkjet printer apparatus. FIG. 4 is a conceptual diagram illustrating an operation S110 of the method of driving the inkjet printer apparatus of FIG. 3.

Referring to FIGS. 1, 3 and 4, the control circuit 300 of the inkjet printer apparatus 400 may determine n pixels arranged in the x-direction X corresponding to an x-direction length of the printing head 100 among a plurality of pixels P arranged as an (N×M)-structure in the target substrate 500, to a single pixel group ('N' and 'M' are natural numbers and 'n' is a natural number such as n<N) (operation S110).

The plurality of pixels P of the target substrate 500 may be divided a plurality of pixel groups PG 1, . . . , PGk ('k' is a natural number). The target substrate 500 may include the plurality of pixel groups PG 1, . . . , PGk based on a number of pixels arranged in the x-direction X of the target substrate 500 and the x-direction length of the printing head 100. In an exemplary embodiment, a last k-th pixel group PGk of the plurality of pixel groups PG1, . . . , PGk may include q pixels smaller than n ('q' and 'N' are natural numbers such as q<N).

Figure 5:
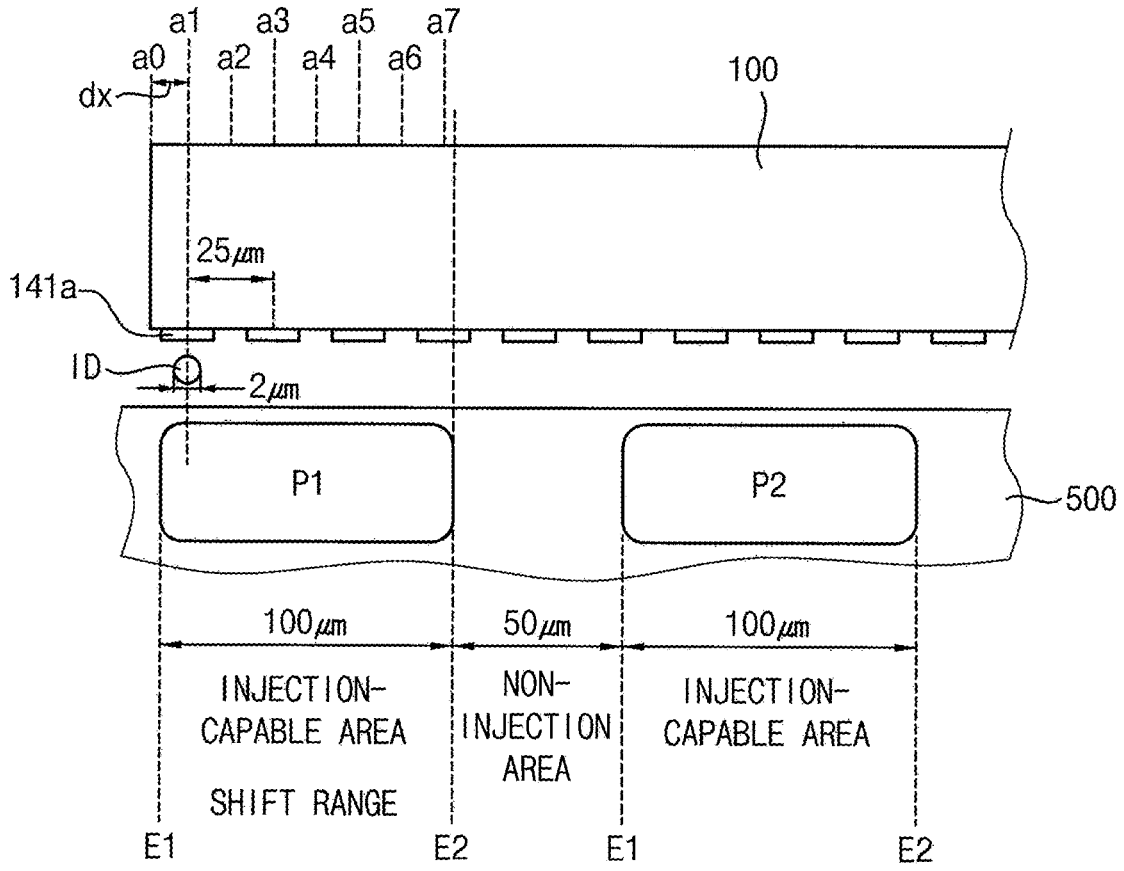
FIG. 5 is a conceptual diagram illustrating operations S120 and S130 of the method of driving the inkjet printer apparatus of FIG. 3.

FIG. 5 is a conceptual diagram illustrating operations S120 and S130 of the method of driving the inkjet printer apparatus of FIG. 3.

Referring to FIGS. 3, 4 and 5, the control circuit 300 (refer to FIG. 1) may determine an initial position of the printing head 100 corresponding to a pixel group PG (operation S120). The control circuit 300 may align a first end portion E1 of a first pixel P1 among the pixels of the pixel group PG and an end portion of a first nozzle 141*a* among the plurality of nozzles in the printing head 100. The control circuit 300 may determine the aligned position to an initial position of the printing head 100.

After the initial position is determined, the control circuit 300 may determine an optimal position of the printing head 100 for printing pixels included in the pixel group PG (operation S130).

In an exemplary embodiment, the control circuit 300 may divide the x-direction length of the first pixel P1 by a reference shift value dx and determine a plurality of shift positions with respect to the x-direction length of the first pixel P1, for example. The shift positions may not deviate from the x-direction length of the first pixel P1 and be determined within the x-direction length of the first pixel P1.

The reference shift value dx may be defined by the following Equation 1.

$$\text{Diameter of Droplet} \pm k1 \leq \text{Reference shift value } (dx) \leq \text{Spacing between Nozzles} \pm k2, \quad \text{[Equation 1]}$$

where Droplet is an ink drop ID injected from a nozzle, and k1 and k2 are experimental values.

In an exemplary embodiment, as shown in FIG. 5, the target substrate 500 may be divided into an injection-capable area corresponding to the x-direction length of each pixel and a non-injection area corresponding to a distance between adjacent pixels in the x-direction X, for example.

In an exemplary embodiment, the x-direction length of the first pixel P1 is about 100 micrometers (μm), for example. The distance between the adjacent first and second pixels P1 and P2 in the x-direction X is about 50 μm. The nozzle spacing of the printing head 100 is about 25 μm. The diameter of the droplet ejected from the nozzle is about 2 μm. In this case, the reference shift value dx may be determined within the range of about 2 μm to about 25 μm according to Equation 1.

In an exemplary embodiment, when the reference shift value dx is determined to about 2 μm, the printing head 100 may have 50 shift positions that move 50 times within the x-direction length of the first pixel P1, for example. When the reference shift value dx is determined to about 25 μm, the printing head 100 may have four shift positions that move four times within the x-direction length of the first pixel P1.

The control circuit 300 may repeatedly move the printing head 100 by the reference shift value dx with respect to the first pixel P1. The control circuit 300 may calculate a number of nozzles of the printing head 100 matched with the pixels arranged in the x-direction X of the pixel group in each of the plurality of shift positions (operation S131).

The control circuit 300 may repeatedly shift the printing head 100 by the reference shift value dx in a range not exceeding the x-direction length from the first end portion E1 of the first pixel P1 to the second end portion E2 facing the first end portion E1, and calculate the number of nozzles of the printing head 100 in the each of the plurality of shift positions.

The control circuit 300 may determine the shift position corresponding to a maximum number among numbers of the nozzles calculated for each shift position as the optimal position of the printing head 100 for the pixel group PG (operation S132).

In an exemplary embodiment, the x-direction length of the first pixel P1 based on the reference shift value dx may include first to seventh shift positions a0, a1, a2, a3, a4, a5, a6 and a7, and the number of pixels arranged in the x-direction X of the pixel group PG may be 100, for example.

The control circuit 300 calculates the number of nozzles of the printing head 100 matched with 100 pixels arranged in the x-direction X in an initial position a0. The control circuit 300 calculates the number of nozzles of the printing head 100 matched with 100 pixels arranged in the x-direction X in a first shift position a1 which is shifted to the initial position a0 by the reference shift value dx. The control circuit 300 calculates the number of nozzles of the printing head 100 matched with 100 pixels arranged in the x-direction X in a second shift position a2 which is shifted to the first shift position a1 by the reference shift value dx. The control circuit 300 calculates the number of nozzles of the printing head 100 matched with 100 pixels arranged in the x-direction X in a third shift position a3 which is shifted to the second shift position a2 by the reference shift value dx. The control circuit 300 calculates the number of nozzles of the printing head 100 matched with 100 pixels arranged in the x-direction X in a fourth shift position a4 which is shifted to the third shift position a3 by the reference shift value dx. The control circuit 300 calculates the number of nozzles of the printing head 100 matched with 100 pixels arranged in the x-direction X in a fifth shift position a5 which is shifted to the fourth shift position a4 by the reference shift value dx. The control circuit 300 calculates the number of nozzles of the printing head 100 matched with 100 pixels arranged in the x-direction X in a sixth shift position a6 which is shifted to the fifth shift position a5 by the reference shift value dx. The control circuit 300 calculates the number of nozzles of the printing head 100 matched with 100 pixels arranged in the x-direction X in a seventh shift position a7 which is shifted to the sixth shift position a6 by the reference shift value dx.

TABLE 1

| | Shift position | | | | | | | |
|---|---|---|---|---|---|---|---|---|
| | a0 | a1 | a2 | a3 | a4 | a5 | a6 | a7 |
| Number of nozzle (EA) | 90 | 80 | 75 | 78 | 85 | 95 | 90 | 91 |

When the number of nozzles calculated for each shift position in the control circuit 300 is equal to Table 1, the control circuit 300 may determine the fifth shift position a5 as the optimal position of the printing head 100.

As shown in FIG. 4, q pixels arranged in the x-direction X included in the k-th pixel group PGk as the last pixel group may be smaller than n pixels of the previous pixel group. In this case, the control circuit 300 may distinguish the nozzles of the printing head 100 into a normal nozzle 141_1 corresponding to q pixels and an abnormal nozzle 141_2 not corresponding to q pixels with respect to the k-th pixel group PGk.

When the optimal position of the k-th pixel group PGk is determined, the control circuit 300 repeatedly moves the printing head 100 by the reference shift value dx with respect to the first pixel P1 of the k-th pixel group PGk, and calculates a number of the normal nozzles 141_1 of the printing head 100 matched with q pixels arranged in the x-direction X of the pixel group. The control circuit 300 may determine a shift position corresponding to a maximum number among numbers of the normal nozzles calculated for each shift position of the printing head 100 as the optimal position of the printing head 100 for the k-th pixel group PGk.

Figure 6:
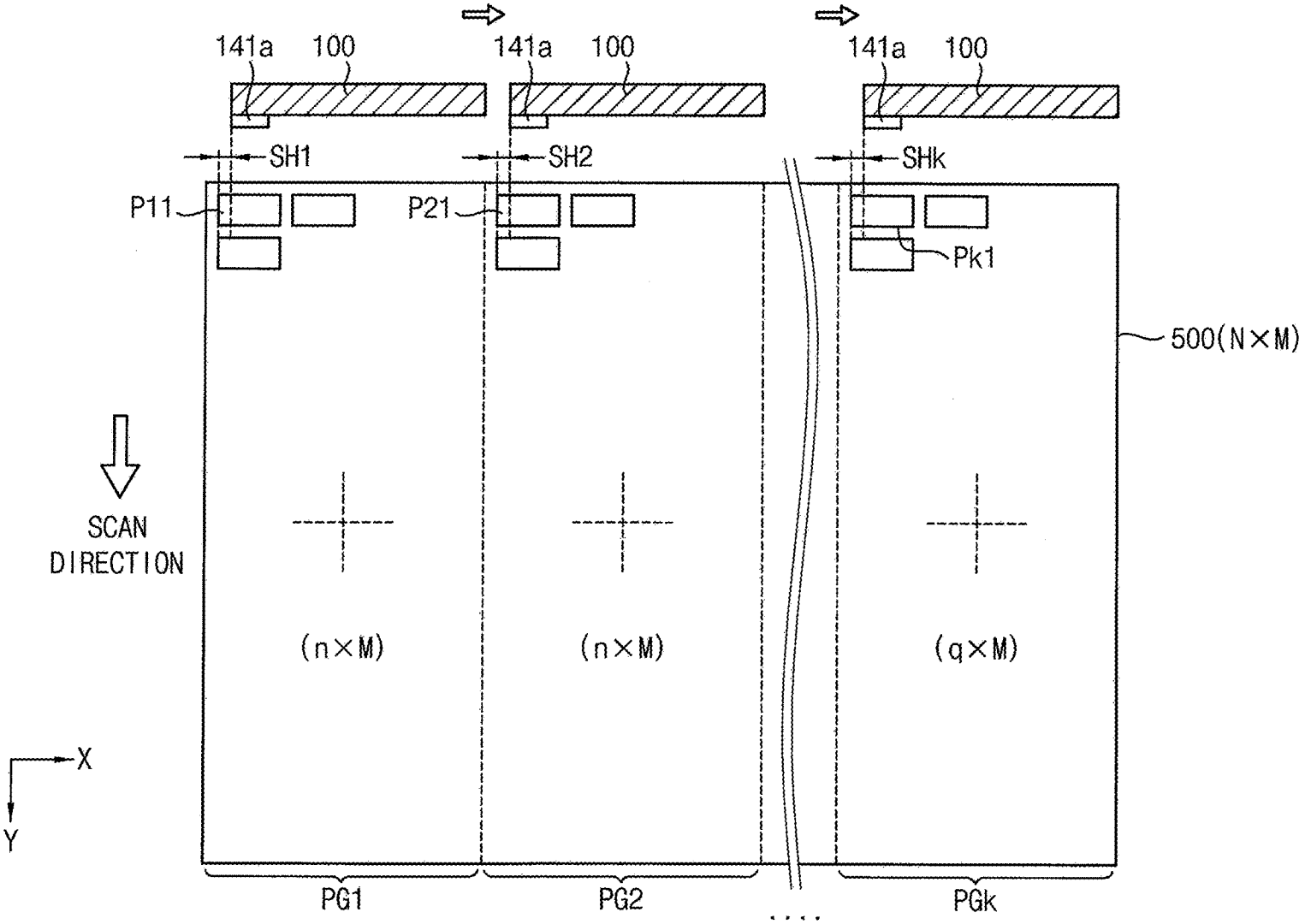
FIG. 6 is a conceptual diagram illustrating operations S140 and S150 of the method driving of the inkjet printer apparatus of FIG. 3.

FIG. 6 is a conceptual diagram illustrating operations S140 and S150 of the method driving of the inkjet printer apparatus of FIG. 3.

Referring to FIGS. 3 and 6, the control circuit 300 may move the printing head 100 to the optimal position determined for each of the pixel groups PG1, PG2, . . . , PGk (operation S140).

After the printing head 100 moves to the optimal position determined in the first pixel of each of the pixel groups PG1, PG2, . . . , PGk, the printing head 100 may print the pixels of each of the pixel groups PG1, PG2, . . . , PGk along the y-direction Y that is the scanning direction (operation S150).

In an exemplary embodiment, the target substrate 500 may include a plurality of pixel groups PG 1, PG 2, . . . , PG k, corresponding to the printing head 100 including a plurality of nozzles arranged in the x-direction X, for example.

The first scan group corresponding to the first pixel group PG1 may include the pixels arranged as an (n×M)-structure. The second scan group corresponding to the second pixel group PG2 may include the pixels arranged as the (n×M)-structure. The k-th scan group corresponding to the k-th pixel group PGk, which is a last pixel group, may include the pixels arranged as a (q×M)-structure (where 'q' is a natural number smaller than 'n').

In an exemplary embodiment, the optimal position of the printing head 100 corresponding to the first pixel group PG1 may be determined into the first shift position SH1 in the first pixel P11, for example. The optimal position of the printing head 100 corresponding to the second pixel group PG2 may be determined into the second shift position SH2 in the second pixel P21. In this way, the optimal position of the printing head 100 corresponding to the k-th pixel group PGk may be determined into the k-th shift position SHk in the second pixel Pk1.

The control circuit 300 moves the printing head 100 to the first shift position SH1, which is the optimal position of the first pixel group PG1, and then the printing head 100 prints the pixels of the (n×M)-structure, which is the first scan group, along the scan direction (y-direction Y).

After printing the first pixel group PG1, the controller 300 moves the printing head 100 to a second shift position SH2 that is an optimal position of the second pixel group PG2. Then, the printing head 100 prints the pixels of the (n×M)-structure, which is the second scan group along the scan direction (y-direction Y).

As described above, the pixels of the target substrate 500 are repetitively printed. After printing a (k−1)-th pixel group (not shown), the control circuit 300 moves the printing head 100 to the k-th shift position SHk which is the optimal position of the k-th pixel group (PGk). Then, the printing head 100 prints the pixels of the (q×M)-structure, which is a k-th scan group, along the scan direction (y-direction Y).

However, referring back to FIG. 4, when the printing head 100 prints pixels of the (q×M)-structure of the k-th scan group corresponding to the k-th pixel group PGk, the control circuit 300 cuts off the power applied to the abnormal nozzles 141_2 of the printing head 100 to prevent the ink from being injected from the abnormal nozzles 141_2.

The control circuit 300 repeatedly moves the printing head 100 in the x-direction X and the y-direction Y until the desired amount of ink is filled in the pixel of the target substrate 500 and the printing head 100 may inject ink to the pixels.

According to exemplary embodiments, the optimal position of the printing head to maximize the plurality of nozzles included in the printing head may be determined. A use efficiency of the nozzle of the printing head may be improved by printing the target substrate in the optimal position. In addition, defects such as clogging of a nozzle that occurs due to not using the nozzle for a long time may be improved. In addition, since the ink is injected by many nozzles, the printing completion time may be shortened.

FIGS. 7 to 10 are cross-sectional views illustrating an exemplary embodiment of a method of manufacturing an organic light emitting display device.

Figure 7:
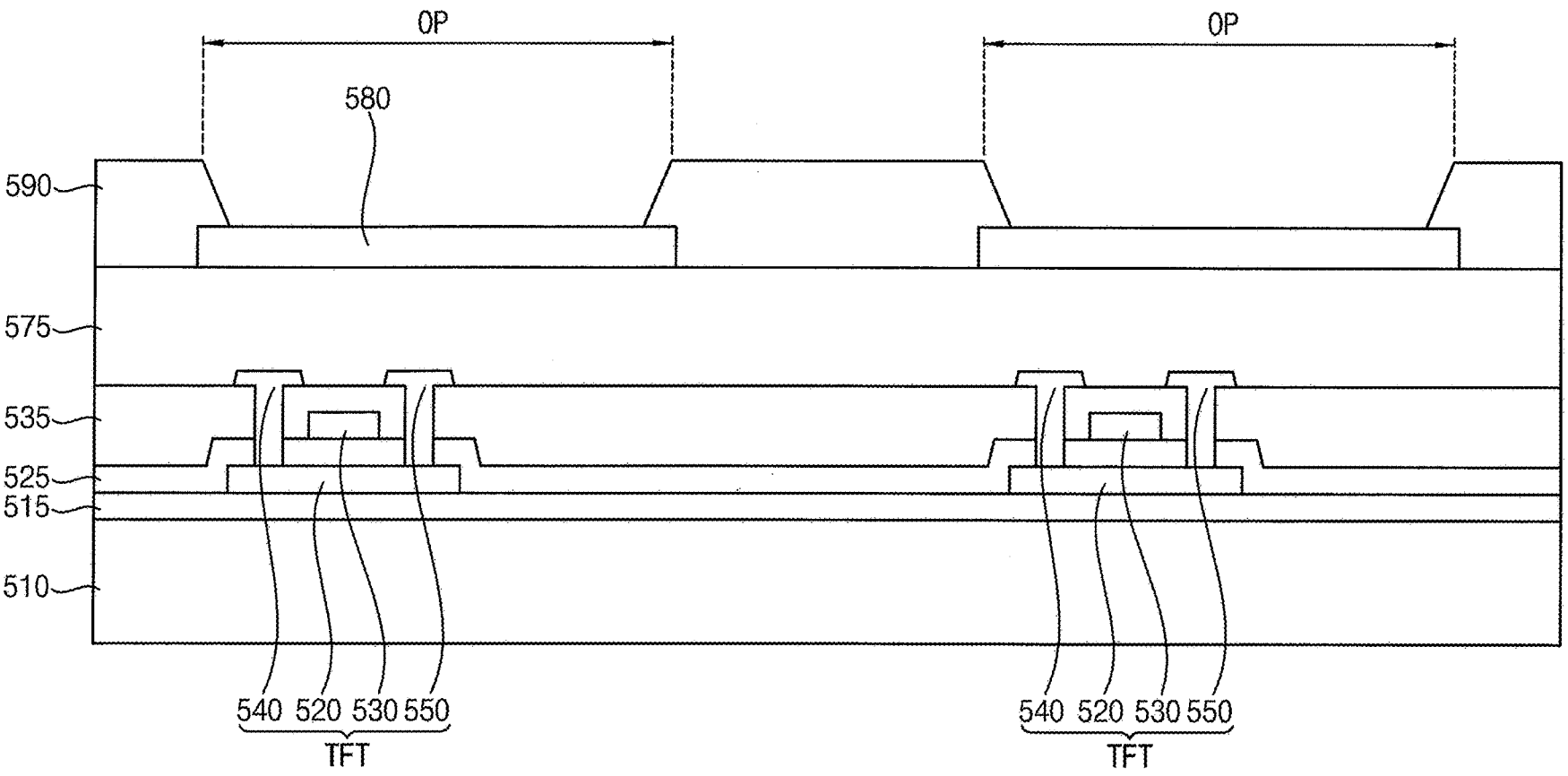
FIGS. 7 to 10 are cross-sectional views illustrating an exemplary embodiment of a method of manufacturing an organic light emitting display device.

Referring to FIG. 7, a buffer layer 515 may be disposed on the substrate 510. In an exemplary embodiment, the buffer layer 515 may be provided by various methods such as chemical vapor deposition, sputtering, etc. using silicon oxide, silicon nitride, silicon oxynitride, or the like, for example.

A thin film transistor TFT may be disposed on a substrate 510 on which the buffer layer 515 is disposed. The thin film transistor TFT may include a semiconductor layer 520, a gate electrode 530, a source electrode 540, and a drain electrode 550.

A semiconductor layer 520 may be disposed on the substrate 510 on which the buffer layer 515 is disposed. In an exemplary embodiment, the semiconductor layer 520 may be provided by forming and patterning a layer including a silicon-containing material, an oxide semiconductor, etc. on the entire surface of the buffer layer 515, for example. When the semiconductor layer 520 is provided using the silicon-containing material, an amorphous silicon layer may be disposed on the entire surface of the buffer layer 515 and the amorphous silicon layer may be crystallized to form a polycrystalline silicon layer. Thereafter, impurities may be doped on both sides of the patterned polycrystalline silicon layer to form a semiconductor layer 520 including a source area, a drain area, and a channel area therebetween.

The gate insulating layer 525 may be disposed on the substrate 510 on which the semiconductor layer 520 is disposed. In an exemplary embodiment, the gate insulating layer 525 may be provided using silicon oxide, silicon nitride, silicon oxynitride, or the like, for example.

A gate electrode 530 may be disposed on the gate insulating layer 525. The gate electrode 530 may overlap the semiconductor layer 520.

An interlayer insulating layer 535 may be disposed on the substrate 510 on which the gate electrode 530 is disposed. In an exemplary embodiment, the interlayer insulating layer 535 may be provided using silicon oxide, silicon nitride, silicon oxynitride, or the like, for example.

A plurality of contact holes exposing the semiconductor layer 520 may be defined in the interlayer insulating layer 535 and the gate insulating layer 525. In an exemplary embodiment, the contact holes may expose the source area and the drain area of the semiconductor layer 520, respectively, for example.

A source electrode 540 connected to the source area and a drain electrode 550 connected to the drain area may be disposed on the substrate 510 on which the interlayer insulating layer 535 is disposed.

A planarization layer 575 is disposed on the substrate 510 on which the source and drain electrodes 540 and 550 are disposed. The planarization layer 575 may include an organic material such as an acrylic resin, an epoxy resin, a polyimide resin, and a polyester resin.

A first light emitting electrode 580 is disposed on the substrate 510 on which the planarization layer 575 is disposed. The first light emitting electrode 580 may be connected to the drain electrode 550 of the thin film transistor TFT through a via hole (not shown) defined in the planarization layer 575.

A pixel defining layer 590 is disposed on the substrate 510 on which the first light emitting electrode 580 is disposed.

In an exemplary embodiment, the pixel defining layer 590 may include at least one of a polyimide-based resin, a photoresist, an acryl-based resin, a polyamide-based resin, a resin, a siloxane-based resin, or the like, for example. The pixel defining layer 590 may be patterned to define an opening OP exposing a part of the first light emitting electrode 580.

Figure 8:
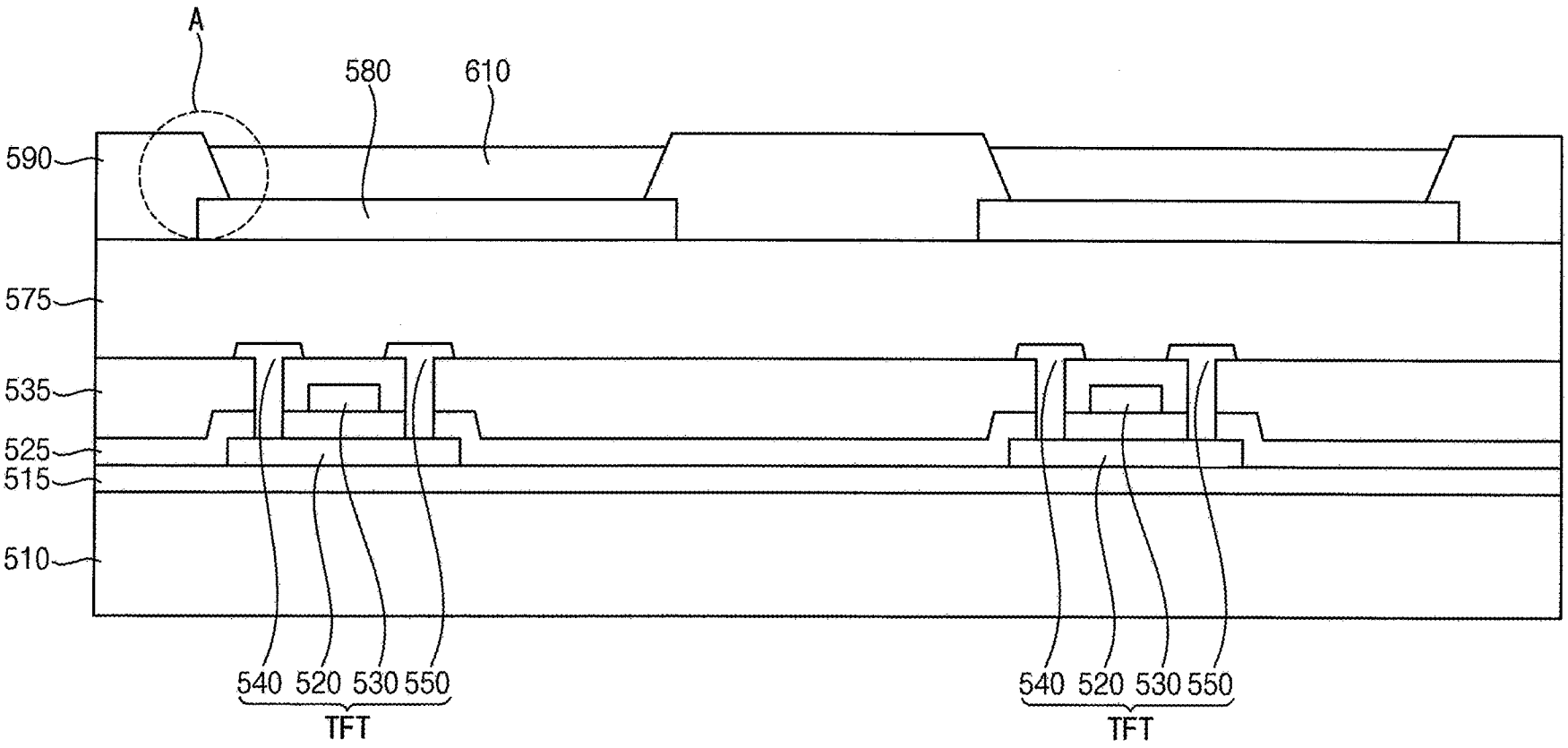
Figure 9:
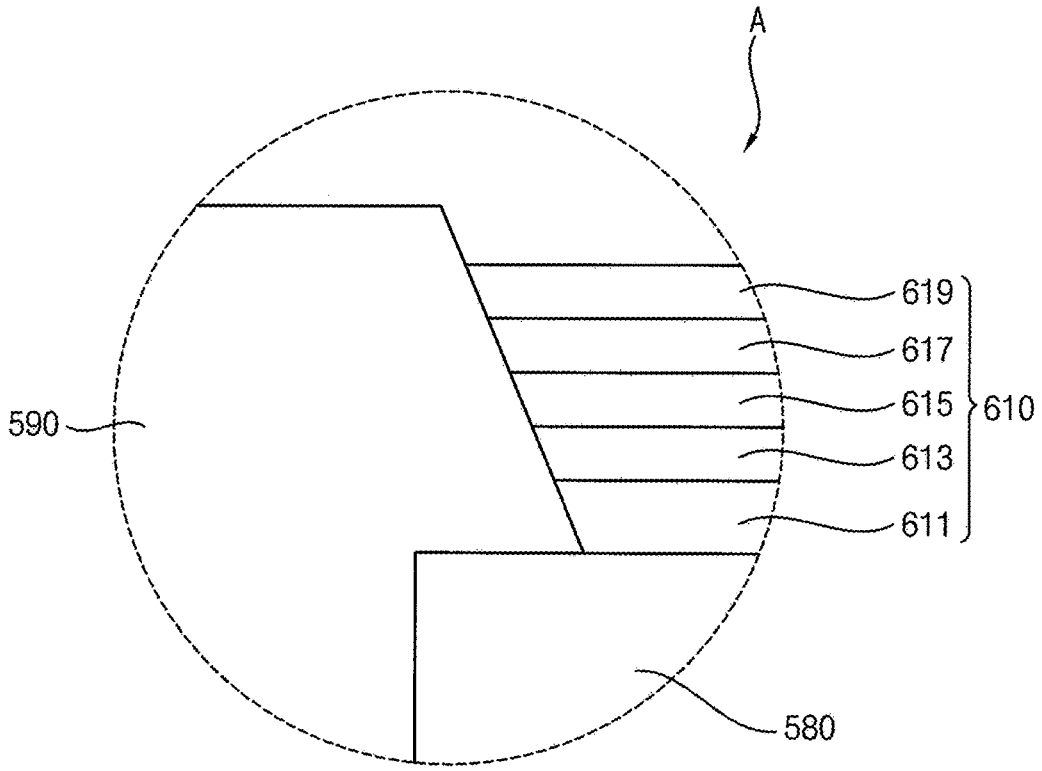

Referring to FIGS. 8 and 9, a light emitting layer 610 may be disposed in the opening OP that exposes the first light emitting electrode 580. In an exemplary embodiment, the light emitting layer 610 may be provided by the inkjet printing method using the inkjet printer apparatus 400 according to the exemplary embodiments as shown in FIGS. 1 to 6, for example.

The target substrate 500 according to the exemplary embodiments may correspond to the substrate 510 on which the pixel defining layer 590, in which the opening OP is defined. The pixel according to the exemplary embodiments may correspond to the opening OP defined in the pixel defining layer 590.

The printing head of the inkjet printer apparatus forms the organic light emitting layer 610 in an opening OP defined above the substrate 510 by the inkjet printing method.

In one exemplary embodiment, the light emitting layer 610 may include a hole injection layer 611, a hole transport layer 613, an electron transport layer 617, an organic light emitting layer 615, and an electron injection layer 619.

Referring to FIG. 9, a hole injection layer 611 is disposed on the first light emitting electrode 580 in the opening OP by an inkjet printing method using the inkjet printer apparatus. A hole transport layer 613 is disposed on the hole injection layer 611 in the opening OP by an inkjet printing method using the inkjet printer apparatus. An organic emission layer 615 is disposed on the hole transport layer 613 in the opening OP by an inkjet printing method using the inkjet printer apparatus. An electron transport layer 617 is disposed on the organic light emitting layer 615 in the opening OP by an inkjet printing method using the inkjet printer apparatus. An electron injection layer 619 is disposed on the electron transport layer 617 in the opening OP by an inkjet printing method using the inkjet printer apparatus.

Figure 10:
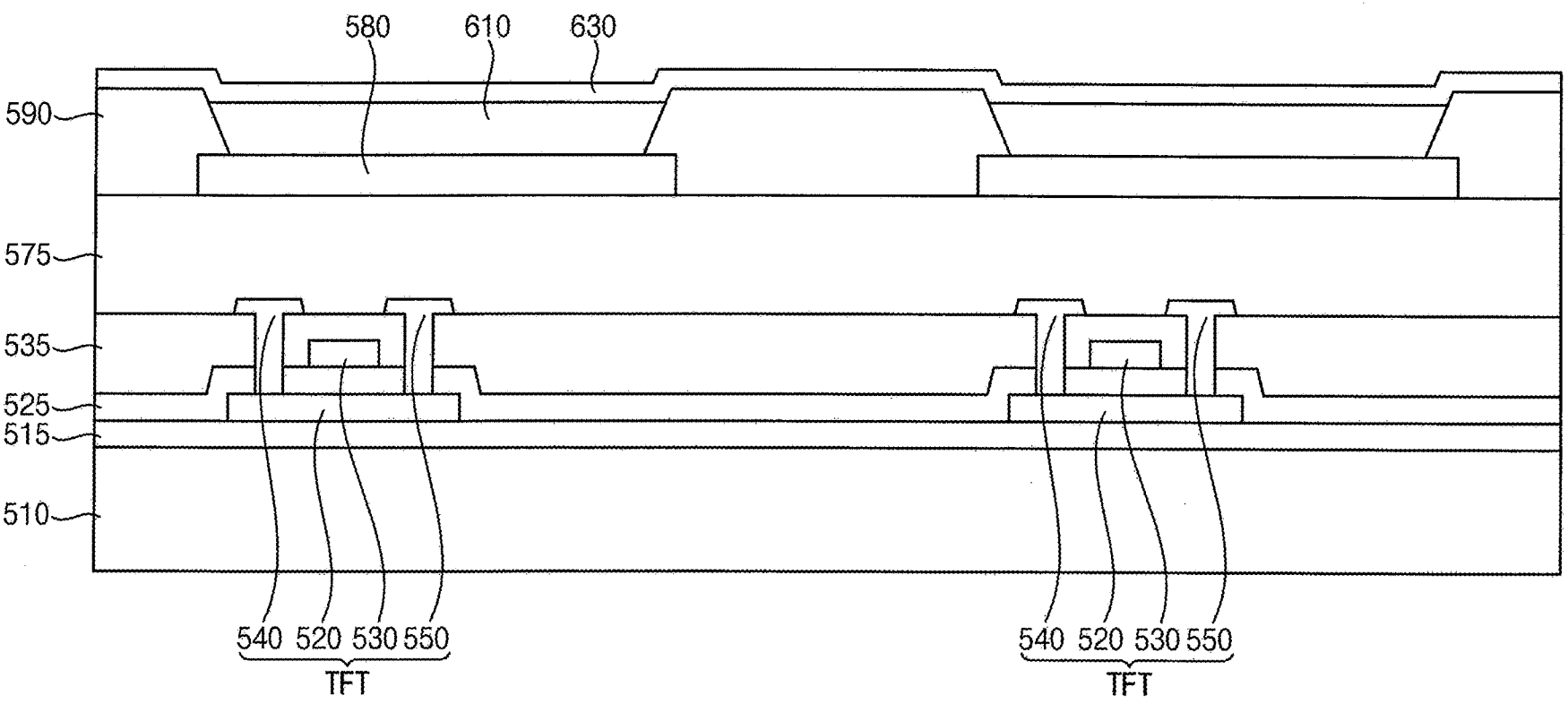

Referring to FIG. 10, a first light emitting electrode 630 is disposed on the substrate 510 on which the light emitting layer 610 is disposed. The first light emitting electrode 630 may be disposed on the substrate 510 as a whole.

Although the formation of the light emitting layer of the organic light emitting display device using the inkjet printer apparatus has been described above with reference to drawing figures, and not limited thereto. Although not shown in drawing figures, a color filter layer included in a color filter substrate of a liquid crystal display device may be provided using the inkjet printer apparatus.

According to exemplary embodiments, the optimal position of the printing head to maximize the plurality of nozzles included in the printing head may be determined. A use efficiency of the nozzle of the printing head may be improved by printing the target substrate in the optimal position. In addition, defects such as clogging of a nozzle that occurs due to not using the nozzle for a long time may be improved. In addition, since the ink is injected by many nozzles, the printing completion time may be shortened.

The invention may be applied to a display device and an electronic device having the display device. In an exemplary embodiment, the invention may be applied to a computer monitor, a laptop, a digital camera, a cellular phone, a smart phone, a smart pad, a television, a personal digital assistant ("PDA"), a portable multimedia player ("PMP"), a MP3 player, a navigation system, a game console, a video phone, etc., for example.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. An inkjet printer apparatus comprising:

a printing head comprising a plurality of nozzles which prints an ink in a plurality of pixels arranged as a matrix type in a target substrate;

a control circuit which moves the printing head in an x-direction crossing an y-direction of a scan direction, and determines an optimal position for using a maximum number of nozzles of the plurality of nozzles; and a driving part which moves the printing head to the optimal position and moves the printing head along the y-direction in the optimal position, wherein the control circuit determines n pixels, among the plurality of pixels, arranged in the x-direction of the target substrate corresponding to an x-direction length of the printing head, to a pixel group, determines the optimal position of the printing head within an x-direction length of a first pixel, among the plurality of pixels, of the pixel group, and wherein the control circuit aligns an end portion of a first nozzle, among the plurality of nozzles, in the printing head and an end portion of the first pixel of the pixel group to determine an initial position, and determines the optimal position of the printing head using a reference shift value preset with respect to the x-direction length of the first pixel in the printing head.

2. The inkjet printer apparatus of claim 1, wherein the control circuit divides the x-direction length of the first pixel by the reference shift value to determine a shift position, calculates a number of nozzles, among the plurality of nozzles, of the printing head matching pixels of the pixel group in the shift position, and determines the shift position having a maximum number of nozzles, among the plurality of nozzles, of the printing head as the optimal position.

3. The inkjet printer apparatus of claim 2, wherein the shift position is within the x-direction length of the first pixel.

4. The inkjet printer apparatus of claim 2, wherein the reference shift value is greater than a diameter of an ink injected from a nozzle of the plurality of nozzles and smaller than a spacing between adjacent nozzles of the plurality of nozzles.

5. The inkjet printer apparatus of claim 1, wherein the reference shift value is defined by following:

$$\text{Diameter of Droplet} \pm k1 \leq \text{Reference shift value (dx)} \leq \text{Spacing between Nozzles} \pm k2,$$

wherein, Droplet is an ink drop ID injected from a nozzle of the plurality of nozzles, and k1 and k2 are experimental values.

6. The inkjet printer apparatus of claim 1, wherein the ink is a light emitting layer used in a manufacturing process of an organic light emitting display device.

7. The inkjet printer apparatus of claim 6, wherein the light emitting layer comprises a hole injection layer, a hole transport layer, an electron transport layer, an organic light emitting layer, and an electron injection layer.

8. The inkjet printer apparatus of claim 1, wherein the ink is a color filter layer used in a manufacturing process of a liquid crystal display device.

9. A method of driving an inkjet printer apparatus which comprises a printing head comprising a plurality of nozzles for printing an ink in a plurality of pixels arranged as a matrix type in a target substrate, the method comprising:

moving the printing head in an x-direction crossing an y-direction of a scan direction;

determining an optimal position for using a maximum number of nozzles of the plurality of nozzles;

moving the printing head to the optimal position;

moving the printing head along the y-direction in the optimal position;

determining n pixels, among the plurality of pixels, arranged in the x-direction of the target substrate corresponding to an x-direction length of the printing head, to a pixel group;

determining the optimal position of the printing head within the x-direction length of a first pixel, among the plurality of pixels, of the pixel group;

aligning an end portion of a first nozzle, among the plurality of nozzles, in the printing head and an end portion of the first pixel of the pixel group to determine an initial position; and determining the optimal position of the printing head using a reference shift value preset with respect to the x-direction length of the first pixel in the printing head.

10. The method of claim 9, further comprising:

dividing the x-direction length of the first pixel by the reference shift value to determine a shift position;

calculating a number of nozzles, among the plurality of nozzles, of the printing head matching pixels of the pixel group in the shift position; and determining the shift position having a maximum number of nozzles, among the plurality of nozzles, of the printing head to the optimal position.

11. The method of claim 10, wherein the shift position is within the x-direction length of the first pixel.

12. The method of claim 9, wherein the reference shift value is greater than a diameter of an ink injected from a nozzle of the plurality of nozzles and smaller than a spacing between adjacent nozzles of the plurality of nozzles.

13. The method of claim 9, wherein the reference shift value is defined by following:

$$\text{Diameter of Droplet} \pm k1 \leq \text{Reference shift value (dx)} \leq \text{Spacing between Nozzles} \pm k2,$$

wherein, Droplet is an ink drop ID injected from a nozzle of the plurality of nozzles, and k1 and k2 are experimental values.

14. The method of claim 9, wherein the ink is a light emitting layer used in a manufacturing process of an organic light emitting display device.

15. The method of claim 14, wherein the light emitting layer comprises a hole injection layer, a hole transport layer, an electron transport layer, an organic light emitting layer, and an electron injection layer.

16. The method of claim 9, wherein the ink is a color filter layer used in a manufacturing process of a liquid crystal display device.

* * * * *